United States Patent [19]

Herold et al.

[11] Patent Number: 4,702,634

[45] Date of Patent: Oct. 27, 1987

[54] CONTINUOUS FEED MECHANICAL PENCIL WITH PUSH BUTTON LEAD FEED ACTUATOR

[75] Inventors: Gerald C. Herold, Janesville; Harley A. Jung, Fort Atkinson, both of Wis.

[73] Assignee: Parker Pen (Benelux) B.V., Breda, Netherlands

[21] Appl. No.: 379,104

[22] Filed: May 17, 1982

[51] Int. Cl.[4] ..... B43K 21/02

[52] U.S. Cl. ..... 401/53; 401/65; 401/104

[58] Field of Search ..... 401/53, 65, 67, 85, 401/104, 105, 106

[56] References Cited

U.S. PATENT DOCUMENTS

| | | | |
|---|---|---|---|
| 271,439 | 1/1883 | Eybel | 401/67 |
| 2,333,876 | 11/1943 | Moore | 401/65 |
| 2,526,268 | 10/1950 | Perraud | 401/85 X |

FOREIGN PATENT DOCUMENTS

| | | | |
|---|---|---|---|
| 685088 | 7/1930 | France | 401/65 |
| 1000831 | 2/1952 | France | 401/104 |
| 1036769 | 9/1953 | France | 401/67 |
| 738695 | 10/1955 | United Kingdom | 401/104 |

*Primary Examiner*—Steven A. Bratlie
*Attorney, Agent, or Firm*—Edmond T. Patnaude

[57] ABSTRACT

A continuous feed mechanical pencil includes a lead cartridge having a lead advancing mechanism responsive to forward axial movement of an actuator button protruding from the rear end of the instrument, the actuator button being fixedly attached to a pocket clip and extending a relatively short distance from the rear of the instrument housing so that the rear end of the actuator is shrouded by the rear end of the housing when the actuator button is fully depressed.

13 Claims, 6 Drawing Figures

CONTINUOUS FEED MECHANICAL PENCIL WITH PUSH BUTTON LEAD FEED ACTUATOR

The present invention relates in general to mechanical pencils having a push type lead advancing mechanism, and it relates in particular to a new and improved actuator mechanism which prevents the application of excessive force to the lead advancing mechanism.

BACKGROUND OF THE INVENTION

Push type mechanical pencils generally employ a rearwardly extending actuator button which is depressed to advance the lead from the forward tip of the instrument. Push pencils of this type have two important advantages over mechanical pencils having a rotary or twist type lead advancing mechanism. One such advantage is that actuation is simpler and more convenient. A second advantage is the fact that the pencil need be loaded with lead much less frequently because a plurality of lead sticks placed in the cartridge are automatically fed seriatem to the lead advancing mechanism in the cartridge. Nevertheless, for esthetic and other reasons twist type lead advancing mechanisms have been used extensively in high quality writing instruments.

However, it would be desirable to provide a high quality writing instrument which is attractive in appearance, has a long maintenance-free life, and yet employs a push type, continuous feed, lead advancing mechanism.

SUMMARY OF THE INVENTION

Briefly, there is provided in accordance with the present invention a new and improved mechanical pencil having a lead advance actuator button which extends from the rear end of the pencil housing and is substantially shrouded by the housing when in its forwardmost position. Accordingly, when the user advances the lead by placing his or her finger or thumb on the actuator button and by pushing the button axially into the housing, the finger or thumb engages the end of the housing to prevent the application of excessive force to the lead advancing mechanism after completion of the forward advance stroke of the actuator button.

In accordance with another feature of the present invention, a pocket clip is attached to the axially movable actuator mechanism internally of the housing, and the actuator mechanism provides the sole support for the pocket clip. In this embodiment of the invention the pocket clip moves forwardly and rearwardly relative to the pencil housing when the actuator button is depressed and subsequently released. The pocket clip incorporates a spring support element which is cantilevered from the actuator mechanism internally of the housing to enable a greater degree of clip opening without damage to the spring support element.

GENERAL DESCRIPTION OF THE DRAWING

The present invention will be better understood by a reading of the following detailed description taken in connection with the accompanying drawing wherein.

DETAILED DESCRIPTION OF A PREFERRED EMBODIMENT OF THE INVENTION

Figure 1:
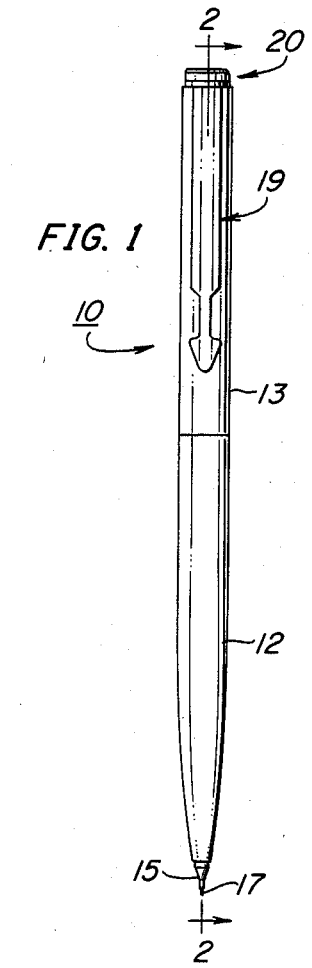
FIG. 1 is a front veiw of a continuous feed push pencil constituting a preferred embodiment of the present invention.

Referring particularly to FIG. 1, a mechanical pencil 10 comprises a barrel 12 to the rear end of which is removably secured a cap 13. The barrel 12 and the cap 13 together form a tubular housing from the front end of which extends a writing tip 15. As shown, a short length of a lead stick 17 extends outwardly from the tip 15. The pencil 10 further includes a pocket clip 19 and a push button 20 which protrudes a short distance from the rear end of the cap 13.

As more fully described hereinafter, the button 20 is attached to the pocket clip 19 internally of the cap 13. Therefor, when the button 20 moves along the longitudinal axis of the cap 13, the pocket clip 19 also moves longitudinally along the side of the cap 13. Depression of the button 20 into the cap 13 advances the lead 17 through the writing tip 15.

Figure 2:
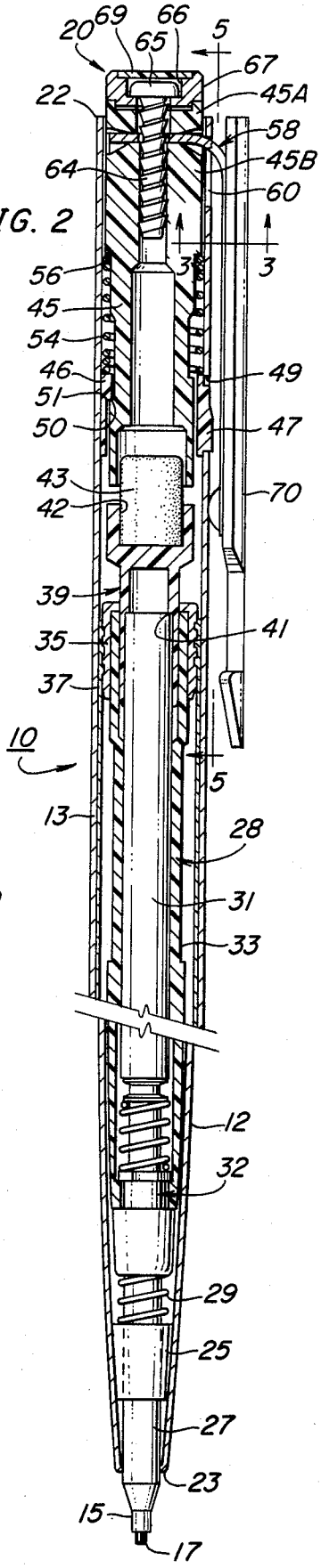
FIG. 2 is a fragmentary, longitudinally sectioned view of the pencil shown in FIG. 1 and taken along the line 2—2 thereof.
Figure 6:
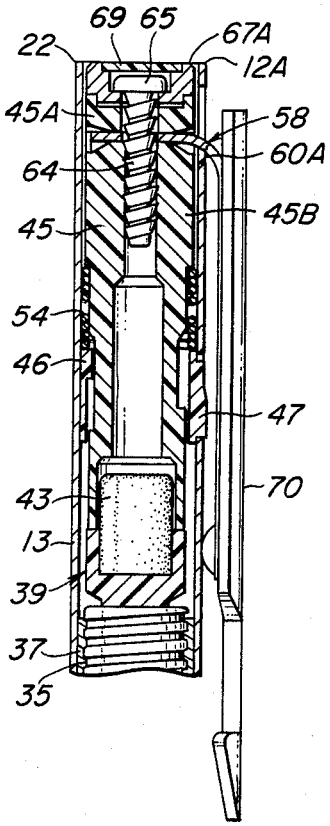
FIG. 6 is a cross-sectional view of the rear end portion of the pencil of FIG. 1 with the actuator mechanism in the forwardmost position.
Figure 3:
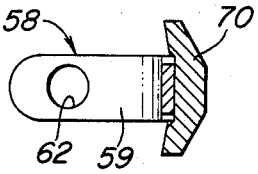
FIG. 3 is a cross sectional view taken along the line 3—3 of FIG. 2 and particularly showing the construction of the pocket clip.

Referring particularly to FIG. 2, the housing may be seen to be tubular and to have an open rear end 22 and an open front end 23. Mounted within the forward end portion of the barrel 12 is a bushing 25. A cylindrical portion 27 of a conventional push type cartridge assembly 28 extends through the bushing 25 and a compression coil spring 29 surrounding the portion 27 seats against the rear end of the bushing 25. The cartridge assembly 28 includes a lead reservoir 31 and a lead advancing mechanism 32 which may be of any suitable construction which responds to forward axial movement of the reservoir 31 in the tubular body 33 of the cartridge to advance lead sticks through the tip 17 and to automatically feed lead sticks seriatem to the tip 17 as the lead sticks are expended. This type of lead advance system is well known in the art and is generally referred to as a continuous feed push pencil mechanism. In U.S. Pat. No. Re. 27,149 assigned to the assignee of the present invention there is shown and described one continuous feed push pencil mechanism of this general type.

As shown, the cartridge assembly 28 is held in place within the barrel 12 by means of a retainer 35 which is affixed over the end of the body 33 and threaded into a clutch sleeve 37 cemented to the interior wall of the barrel 12. An eraser holder and ferrule 39 is suitably formed of plastic and fits snugly over the rear end of the reservoir tube 31. An internal annular shoulder 41 seats against the rear end of the reservoir tube 31 thereby to constitute an operating part of the lead advance mechanism. The ferrule 39 has a rearwardly opening cylindrical blind hole 42 in which an eraser 43 is located. It may thus be seen that forward axial movement of the ferrule 39 causes the lead in the cartridge 28 to advance through the tip 17.

In order to apply a forward thrust to the lead advance mechanism in the cartridge 28, an actuator means which includes the actuator button 20 is slidably mounted in the cap 13 rearwardly of the cartridge 28. The actuator means includes a generally tubular plunger 45 slidably extending through a guide sleeve 46 which is fixedly positioned within the cap by means of an integral lug 47. As shown, the lug 47 extends into a rectangular opening 49 in the cap 13. A forwardly facing stop shoulder 50 on the guide sleeve 46 cooperates with a rearwardly facing shoulder 51 on the plunger 45 to limit rearward movement of the plunger 45 within the cap 13. A compression coil spring 54 is slightly compressed between the rear end of the sleeve 46 and a forwardly facing annular shoulder 56 on the plunger 45 to bias the plunger into its rearwardmost position as shown in FIG. 2. As may best be seen in FIG. 1, for esthetic reasons the pocket clip overlies the lug 47 and associated opening 49 so as to visually hide it. The forward end portion of the plunger 45 is tubular and freely fits over the eraser 43 so as to abut the ferrule 39 and transmit a forward thrust to the lead advance mechanism when the plunger 45 is moved forwardly in the cap.

Figure 4:
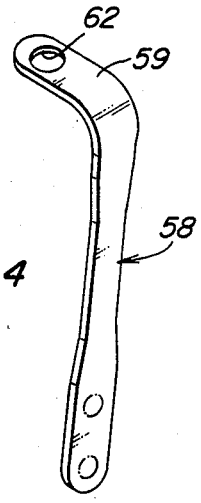
FIG. 4 is a perspective view of the spring support element of the pocket clip.

In order to mount the pocket clip 19 to the pencil in an attractively appearing and yet strong and durable manner, the clip is affixed to the plunger and moves relatively freely along the cap 13 when the plunger is moved axially to advance the lead. More particularly, the pocket clip 19 includes a leaf spring member 58, shown in perspective in FIG. 4, having an offturned upper end portion 59 which extends through a rectangular slot 60 (FIG. 5) in the cap 13. The end portion 59 is disposed between upper and lower plunger parts 45A and 45B and is provided with a hole 62 aligned with centrally disposed longitudinal bores in the plunger parts 45A and 45B. A self-tapping screw 64 has its head portion 65 located in a counterbore 66 in a tassie member 67 and is threaded into the bore in the forward plunger part 45B to firmly attach the pocket clip to the plunger. An ornamental disc 69 is press-fitted into a counterbore at the distal end of the tassie to hide the screw 64 from view. An arrow shaped ornamental part 70 is attached to the spring support member 58 by any suitable means such as spot welding.

OPERATION

Figure 5:
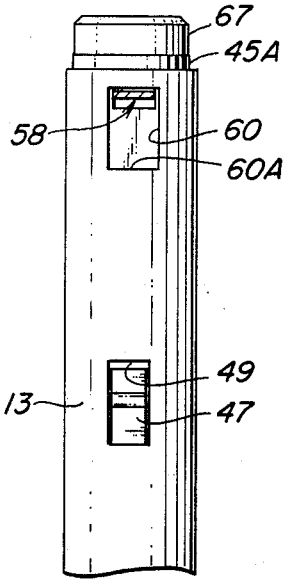
FIG. 5 is a partially sectioned view of the pencil of FIG. 1, taken along the line 5—5 in FIG. 2.

It may be seen from an inspection of FIGS. 1, 2 and 5 that the tassie member 67 and the rear end portion of the plunger part 45A constitute a push button which extends a short distance from the rear end of the pencil housing when the actuator mechanism is in its released, rearwardmost position. When this actuator button is depressed, the plunger 45 is moved axially toward the pencil tip 15 until its forward end engages the rear end of the reservoir sleeve 31. Further forward movement of the actuator button applies a forward axial thrust to the reservoir sleeve and associated lead advance mechanism to advance the lead 17 through the tip 15 of the pencil. The possible forward stroke of the advance mechanism is self limiting when the clip element 58 engages the bottom edge 60A of the slit 60 through which the element 58 extends. However, before that forward limit of the actuating stroke has been reached, the planar distal end 67A of the tassie 67 is flush with the planar rear end 12A of the cap 13 thereby preventing the application of any further axial thrust by normal use of the user's thumb or finger. Damage to the relatively delicate parts of the pencil is thus prevented by normal use of the pencil.

While the present invention has been described in connection with a particular embodiment thereof, it will be understood by those skilled in the art tha many changes and modifications may be made without departing from the true spirit and scope of the present invention. Therefore, it is intended by the appended claims to cover all such changes and modifications which come within the true spirit and scope of this invention.

What is claimed:

1. A mechanical pencil, comprising a generally tubular housing having open front and rear ends, a lead reservoir and lead advance mechanism mounted within said housing, said lead advance mechanism being responsive to a forward axial thrust applied thereto to advance lead contained in said reservoir through the front end of said pencil, actuator means slidingly mounted in said housing rearwardly of said lead advance mechanism for transmitting an axial force applied to said actuator means to said lead advance mechanism as said actuator means is moved from its rearwardmost position to its forwardmost position, said actuator means including an actuator button protruding from said rear end of said housing when said actuator means is in said rearwardmost position, and said actuator means having a forward stroke between said rearwardmost and forwardmost positions which is no shorter in length than the maximum distance said actuator button protrudes from said rear end of said housing when said actuator means is in said rearwardmost position, whereby said actuator button is shrouded by said housing when said actuator means is in its forwardmost position.

2. A mechanical pencil according to claim 1 and further comprising a pocket clip secured to said actuator means and axially movable with said actuator means relative to said housing.

3. A mechanical pencil according to claim 2 wherein said housing is provided in the wall thereof with a longitudinal slot, and said pocket clip extends through said slot.

4. A mechanical pencil according to claim 3 wherein said actuator means provides the sole support for said pocket clip.

5. A mechanical pencil according to claim 2 wherein said actuator means comprises a generally cylindrical plunger slidable in said housing, said plunger comprises first and second axially aligned parts, and said pocket clip has a portion fixedly secured between said parts.

6. A mechanical pencil according to claim 5 wherein the portion of said pocket clip disposed between said parts is provided with an aperture, and said parts are fastened together by fastening means extending through said aperture.

7. A mechanical pencil according to claim 5 wherein the rear one of said parts constitutes at least a portion of said button.

8. A mechanical pencil according to claim 1 comprising spring means disposed in said housing for resiliently biasing said actuator means into said rearwardmost position.

9. A mechanical pencil according to claim 8 wherein said housing comprises a forward barrel portion and a rear cap portion, said actuator means being mounted solely within said cap portion

10. A mechanical pencil according to claim 8 comprising seat means mounted in said housing and having a lug thereon extending into an opening in the wall of said housing and a pocket clip positioned over said opening and said lug to hide said lug from view.

11. A mechanical pencil, comprising a generally tubular barrel having open front and rear ends, a lead reservoir and lead advance mechanism mounted within said barrel, said lead advance mechanism being responsive to a forward axial thrust applied thereto to advance lead contained in said reservoir through the front end of said pencil, a generally tubular cap having open front and rear ends, said cap being affixed to the rear end of said barrel, actuator means slidingly mounted in said cap for transmitting an axial force applied to said actuator means to said lead advance mechanism as said actuator means is moved from its rearwardmost position to its forwardmost position, said actuator means including an actuator button protruding from said rear end of said cap when said actuator means is in said rearwardmost position, and said actuator means having a forward stroke between said rearwardmost and forwardmost positions which is no shorter in length than the maximum distance said actuator button protrudes from said rear end of said cap when said actuator means is in said rearwardmost position, whereby said actuator button is shrouded by said cap when said actuator means is in its forwardmost position.

12. A mechanical pencil according to claim 11, comprising spring means mounted in said cap for resiliently biasing said actuator means into its said rearwardmost position.

13. A mechanical pencil according to claim 12 wherein said actuator means comprises seat means mounted in said cap for retaining said spring means in said cap, said seat means having a transversely extending lug extending into an opening in the wall of said cap, and a pocket clip affixed to said actuator means and extending over said opening.

* * * * *